United States Patent [19]

Hixenbaugh

[11] Patent Number: 4,653,064

[45] Date of Patent: Mar. 24, 1987

[54] GAS COLLECTOR FOR METALLURGICAL VESSELS

[75] Inventor: Dennis L. Hixenbaugh, Pittsburgh, Pa.

[73] Assignee: Pennsylvania Engineering Corporation, Pittsburgh, Pa.

[21] Appl. No.: 782,861

[22] Filed: Oct. 2, 1985

[51] Int. Cl.[4] ..... F27D 17/00

[52] U.S. Cl. ..... 373/9; 98/115.4; 266/144

[58] Field of Search ..... 373/8, 9, 79, 81; 432/72; 266/144, 148, 158, 159; 98/115.1, 115.4

[56] References Cited

U.S. PATENT DOCUMENTS

| | | | |
|---|---|---|---|
| 2,269,645 | 1/1942 | Browning . | |
| 2,954,968 | 10/1960 | Vedder . | |
| 3,834,293 | 9/1974 | Danieli | 266/144 |
| 3,913,470 | 10/1975 | Cullen | 98/115.4 |
| 3,926,104 | 12/1975 | El Dorado | 266/144 |
| 3,928,144 | 12/1975 | Jakimowicz . | |
| 3,938,788 | 2/1976 | Josten . | |
| 4,088,824 | 5/1978 | Bonistalli . | |
| 4,143,864 | 3/1979 | Laimer et al. . | |
| 4,286,776 | 9/1981 | Laimer . | |
| 4,410,166 | 10/1983 | Hixenbaugh et al. . | |
| 4,477,910 | 10/1984 | Nijhawan et al. . | |
| 4,506,370 | 3/1985 | Yoshimatsu | 373/9 |

OTHER PUBLICATIONS

Closing in on Arc Furnace Emissions at Carpenter Technology, reprinted from Iron and Steel Engineer, Mar. 1984.

*Primary Examiner*—Roy N. Envall, Jr.
*Attorney, Agent, or Firm*—Fred Wiviott

[57] ABSTRACT

A pollution control system for electric arc furnaces includes fume collectors disposed at one side and above the furnace and pairs of blower nozzles mounted on an overhead crane used to deliver feed materials to the furnace. One nozzle of each pair is adjustable in a vertical plane and the other nozzle of each pair is adjustable in vertical and horizontal planes so that the nozzles may be positioned for blowing furnace fumes into the fume collectors when the furnace roof is elevated for charging, during furnace operation and when the furnace is tilted for tapping.

7 Claims, 7 Drawing Figures

GAS COLLECTOR FOR METALLURGICAL VESSELS

BACKGROUND OF THE INVENTION

This invention relates to pollution control systems and more particularly to particulate and gas collection systems for electric arc furnaces.

Electric arc furnaces are commonly employed in a variety of metallurgical operations, such as the melting of scrap metal and in the refining of iron and steel. Such electric arc furnaces generally include a furnace body and a removable roof through which the electrodes extend. Periodically during a furnace operation, the roof and electrodes are elevated and swung away from the furnace body to permit charging with scrap, hot metal, pig iron or other furnace charge. In addition, when the treatment of each batch of metal in the furnace is completed, the furnace is tapped and the molten metal collected in a ladle located along one side of the furnace. During the charging and tapping operations, large amounts of polluting gases and particulate matter are released into the surrounding environment. Additional pollutants are also released from the furnace through various openings during the furnace metallurgical operations.

One type of prior art systems for collecting gaseous and particulate pollutants from electric arc furnaces includes a furnace enclosure having collection ducts located at critical positions therein. Examples of such prior art furnace enclosures are disclosed in U.S. Pat. Nos. 4,088,824 and 4,477,910. Each of these patents discloses a first gas and particulate collector adjacent the upper end of the enclosure and a second collector adjacent the tapping ladle position.

Another example of a prior art pollution control system for electric arc furnaces is disclosed in U.S. Pat. No. 4,410,166 which shows an arc furnace enclosure having a gas collector which is movable to permit furnace charging.

A further expedient employed in the prior art for collecting pollutants and arc furnace enclosures involves blowers for directing gases and particulate material toward prepositioned collectors.

Such prior art gas collecting systems have generally been a compromise with respect to various furnace sizes, operating sequences and pollution sources.

SUMMARY OF THE INVENTION

It is an object of the invention to provide a new and improved pollution control system for electric arc furnaces.

A further object of the invention is to provide a pollution control system for electric arc furnaces which is not dependent on furnace size or the particular furnace operation being performed.

Yet another object of the invention is to provide a pollution control system which can effectively capture pollutants from various locations around the furnace.

These and other objects and advantages of the present invention will become more apparent from the detailed description thereof taken with the accompanying drawings.

In general terms the invention comprises a system for collecting pollutants from an electric arc furnace having a removable cover and a teeming spout wherein molten products may be discharged into a container disposed adjacent one side of the furnace. An overhead crane is movable above the furnace for positioning a charging bucket or a container of molten metal avove the furnace. Pollution collection means are disposed above and to one side of the furnace with the crane being movable bidirectionally relative to the collector. Nozzle means is mounted on the crane and is operative for blowing an air stream toward the collector. The crane is operable to position the nozzle means on the side of the furnace opposite the collector and in alignment with the furnace during a charging operation when the furnace roof is in an open position. The crane is also operable to move the nozzle in a direction parallel to the collector inlet and to a second position whereby the pollutants rising from the container during a teeming operation are between the nozzle and the collector.

DETAILED DESCRIPTION OF THE PREFERRED EMBODIMENT

Figures 1, 5:
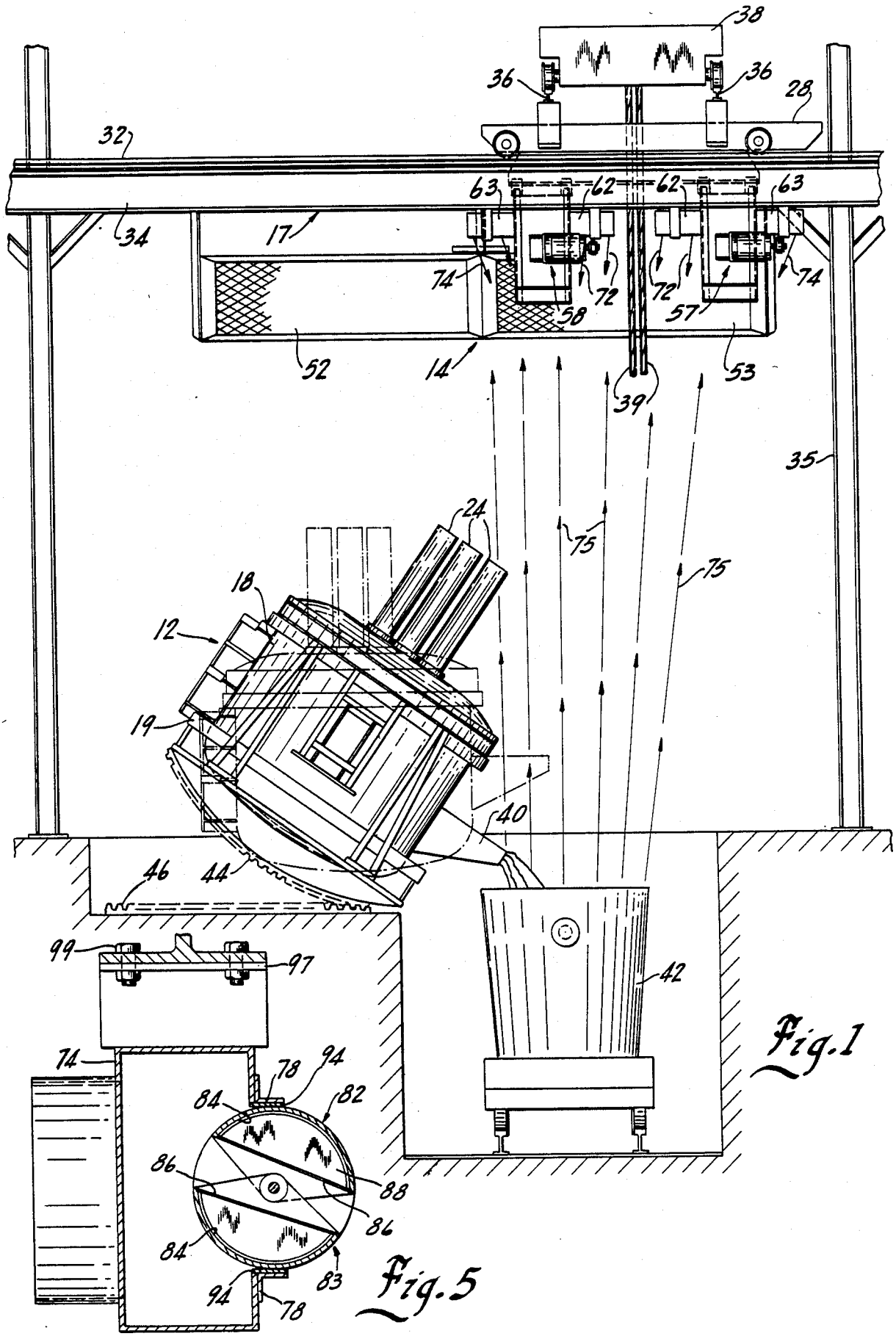
FIG. 1 is a side elevational view of the gas collecting system in accordance with the preferred embodiment of the invention.
FIG. 5 is a view taken along lines 5—5 of FIG. 4.
Figure 2:
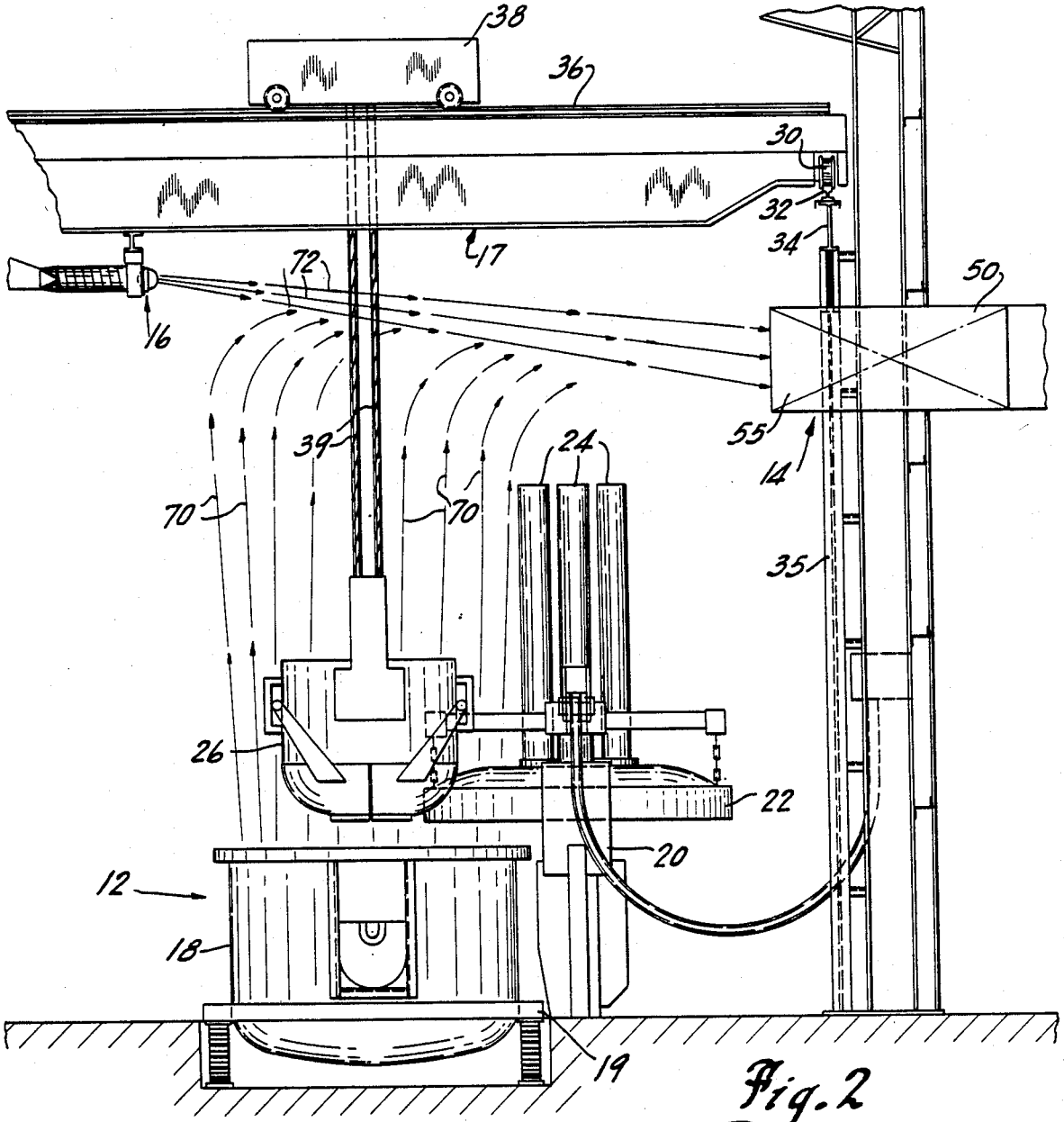
FIG. 2 is an end view of the gas collecting system shown in FIG. 1.
Figure 7:
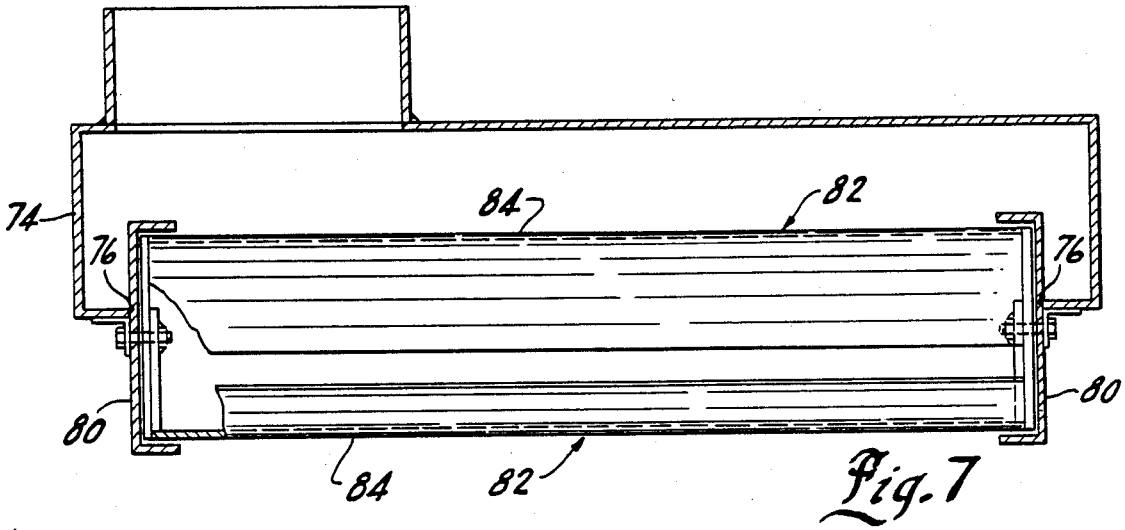
FIG. 7 is a front view of a fragmentary portion of the blower assembly of FIG. 3.

FIGS. 1 and 2 show a gas collecting system in accordance with the preferred embodiment of the invention as applied to a conventional electric arc furnace 12. In general terms, the system includes gas collectors 14 disposed generally above and to one side of the furnace 12 and a blower assembly 16 mounted on an overhead crane 17 movable generally above and to the oppposite sides of the furnace 12.

Because the furnace 12 is conventional, it will not be described in detail for the sake of brevity. It will be sufficient for purposes of understanding the invention to state that the furnace 12 includes a furnace body 18 which is mounted on a platform 19. Also mounted on the platform 19 and adjacent the body 18 is a vertically extending column 20 which supports the furnace roof 22 and the furnace electrodes 24. Means not shown, but which are well known in the art, are mounted on the column 20 for elevating the furnace roof 22 relative to the furnace body 18 and the electrodes 24 relative to the roof 22 as well as the body 18. The column 20 also includes rotating means (not shown) so that the elevated roof 22 and electrodes 24 may be swung to one side of the furnace body 18 to permit the contents of a container 26, to be discharged into the furnace body 18. This material may comprise, for example, scrap, pig iron or hot metal which is to be melted, refined or otherwise treated within the electric arc furnace 10. While the container 26 is shown to be a charging bucket, it may also be a ladle if hot metal is to be charged into the furnace 12.

After the contents of the container 26 is discharged into the furnace body 18, the column 20 is again rotated to position the furnace roof 22 over the furnace body 18. The roof 22 and the electrodes 24 are then lowered into their operative positions. Electrodes 24 may then be energized for melting or otherwise treating the contents of the furnace 12.

The overhead crane 17 is conventional, and is provided for moving the container 26 or a ladle into a position above the furnace body 18 to permit charging. The crane may include a generally rectangular frame 28 and spaced apart wheels 30 which are disposed along each of its opposite sides and adjacent each end. The wheels 30 are mounted on rails 32 which in turn are supported on beams 34 forming part of the framework 35 for a furnace enclosure or shop building. The rails 32 and the beams 34 which support them are shown to be disposed in a generally horizontal, parallel, spaced apart relation above and on the opposite sides of the furnace 12. As those skilled in the art will appreciate, the crane 28 includes an electrical or hydraulic drive mechanism for moving the frame 28 along the rails 32 and above the furnace 12. Mounted atop the frame 28 are a second pair of rails 36 for receiving a trolley 38 from which the bucket 26 is supported by means of cables 39. It will be appreciated by those skilled in the art that the trolley 38 also includes conventional means (not shown) for moving the same over the rails 36 and for elevating and lowering the bucket 26 through the agency of the cables 39.

The furnace 12 is also provided with a pouring spout 40 so that the molten metal within the furnace may be periodically discharged into a teeming ladle 42. To this end, the platform 19 is mounted on a pair of parallel, spaced apart toothed rockers 44 each of which engages a complimentary rack 46. Hydraulic means (not shown) are provided for tilting the furnace 12 from its position shown by broken lines in FIG. 1 to its position shown by full lines wherein the contents of the furnace 12 may be discharged into the teeming ladle 42 after the treatment or melting of the metal within the furnace 12 has been completed. Thereafter, the furnace body 18 is returned to its operative position and the roof 22 and the electrodes 24 are again elevated and pivoted to permit the furnace 12 to be recharged.

The gas collector 14 includes a duct 50 which is connected to a gas cleaning system (not shown) which includes a suction fan. The duct 50 is supported on the framework 35 and includes a pair of inlet openings 52 and 53 as seen in FIG. 2. First inlet opening 52 is shown to be in alignment with the furnace 12 when the same is in its upright operating position. The second inlet opening 53 is in general alignment with the area above the teeming ladle 42. Each of the inlet openings 52 and 53 is provided with an individually operable damper 55 so that the openings 52 and 53 may be selectively opened and closed.

Figure 4:
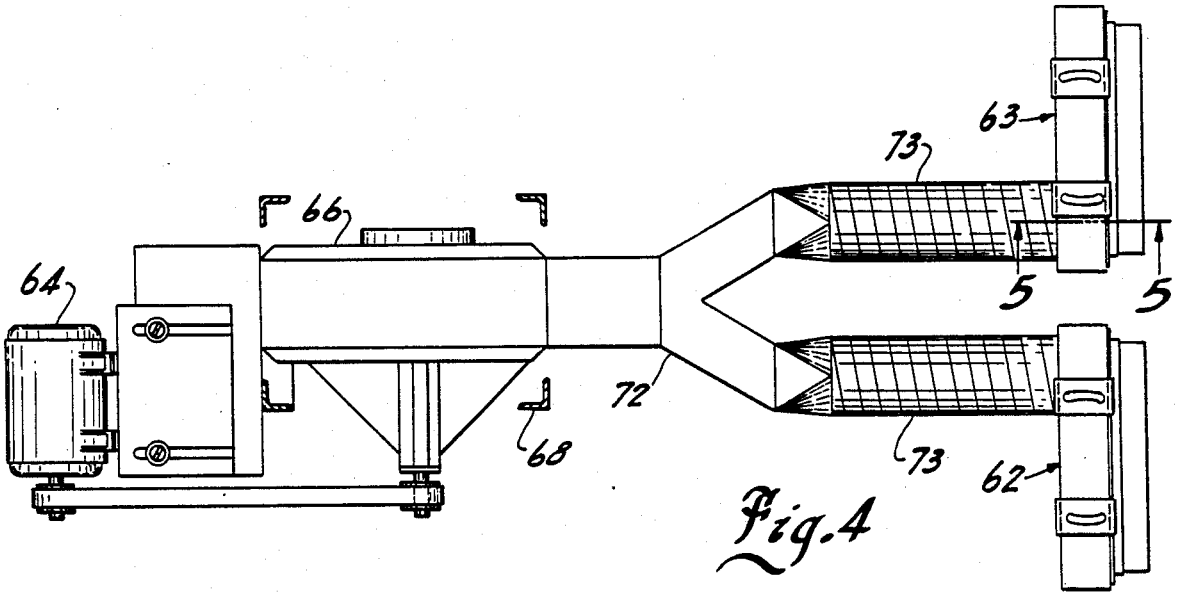
FIG. 4 is a top plan view of the blower assembly shown in FIG. 3.
Figure 3:
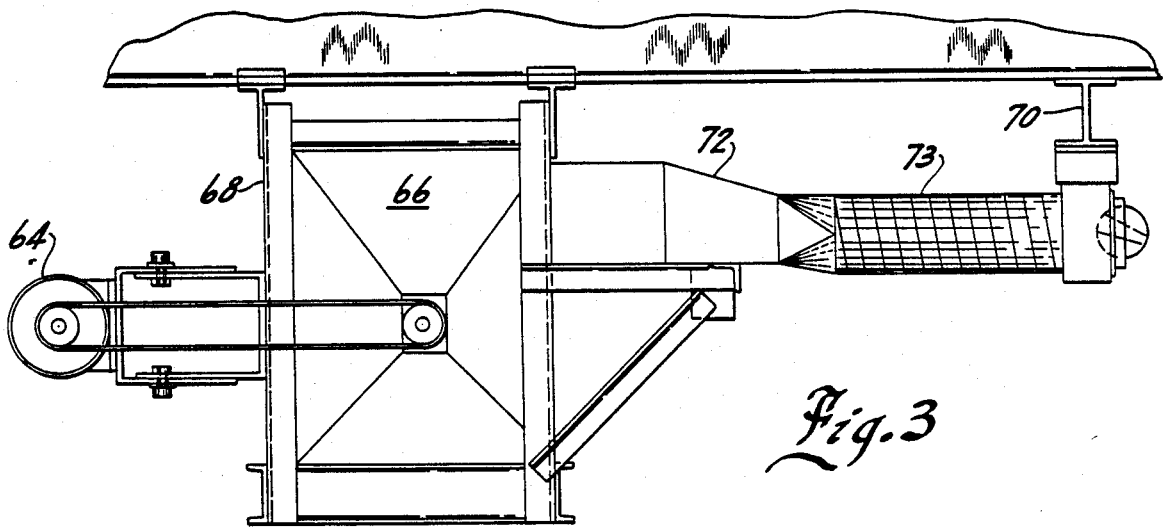
FIG. 3 a fragmentary view showing a side view of the blower assembly of the gas collecting system of FIG. 1.
Figure 6:
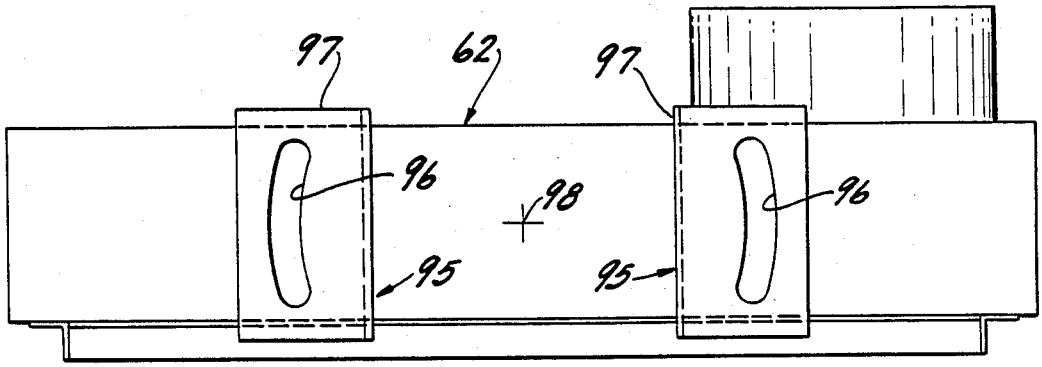
FIG. 6 is a top view of a fragmentary portion of the blower assembly of FIG. 3.

The blower assembly 16 preferrably includes a pair of separate nozzle assemblies 57 and 58 which are mounted in spaced apart relation on one side of the crane 28 and parallel with the inlet openings 52 and 53. Nozzle assemblies 57 and 58 are identical and accordingly, only nozzle assembly 57 will be discussed in detail for the sake of brevity. With reference to FIGS. 3 and 4, the nozzle assembly 57 is shown to include a blower 60 and a pair of horizontally spaced apart nozzles 62 and 63. The blower 60 includes a motor 64 and a fan 66 supported by a frame 68 below the frame 28 of crane 17. The nozzles 62 and 63 are also supported beneath frame 28 by short I-beam sections 70 and are connected to the fan 66 by a Y-shaped duct 72 and flexible conduit sections 73.

Each nozzle includes a rectangular chamber 74 coupled at one side to one of the flexible duct sections 73 and having a rectangular window 76 formed in its opposite side. Flanges 78 and define the upper and lower margins of window 76 and its sides are defined by dished end caps 80 suitably affixed to the vertical edges of window 76. A pair of opposed flow deflectors 82 and 83 are disposed within window 78 and each includes a cap plate 84 which defines a cylindrical section. A rectangular flow plate 86 is fixed to the inner edge of each cap plate 84 and its opposite ends are closed by semi-circular end plates 88. The flow deflectors 82 and 83 are mounted for pivital movement on the end caps 80 by means of bolts 90 which extend through aligned openings in the end caps 80 and generally triangular adjusting vanes 92 and 93 fixed to the opposite ends of flow deflectors 82 and 83, respectively.

It will be appreciated that the spaced apart flow plates 86 define a flow path from chamber 74. By adjusting the horizontal and angular position of flow deflectors 82 and 83 the vertical discharge angle of the air discharging from chamber 74 may be adjusted within limits defined by the flanges 78. It will also be appreciated that the angle between the flow plates 86 can be adjusted to a limited extent. Felt strips 94 may be disposed between the flanges 78 and the cap plates 84 for sealing the gap therebetween.

Each of the nozzles 62 and 63 are supported from the I-beam sections 70 by a pair of inverted, L-shaped brackets 95 which are affixed at their lower edges in spaced apart relation to the upper surface of the chamber 74. Each of the brackets 95 has an arcuate slot 96 formed its upper flange 97. The slots 96 have a common center of curviture 98 which lies midway between the brackets 95. Bolts 99 extend through slots 96 and holes 100 formed in I-beam sections 70. It will be appreciated that by loosing the bolts 99 the nozzles 62 and 63 may be pivoted through a horizontal angle whose limits are defined by the length of the slots 96. To permit such horizontal adjustment, the conduit section 73 are preferrably formed of a material that permits limited flexibility such as interlocked metal hose having a smooth internal bore.

When the furnace roof 22 is in its open position shown in FIG. 2, polluting gases and particulate matter, symbolized by arrows 70, will discharge from the open upper end of the furnace body 18. As the pollutants 70 rise, they move between the inlets 52 and 53 of the gas collector 14 and the blower assembly 16. The first nozzle 62 of each nozzle assemblies 57 and 58 will be positioned for blowing air directly toward the gas collector 14 as symbolized by arrows 72 and the second nozzle 63 of each is positioned to blow air downwardly and inwardly toward the column of rising pollutants as symbolized by the arrows 74. In addition, the crane 17 is positioned so that the container 26 will be directly over the furnace 12. This positions the nozzle groups 57 and 58 so that they are spaced apart a distance approximately equal to the width of the furnace 12 and with one nozzle group disposed along each side of the furnace 12. As a result, the nozzles will be positioned so that their individual air streams blow inwardly and downwardly toward the rising column of pollutants 70 and for directing the same into the inlet 52 whose damper is in an open position while the damper 55 of inlet opening 53 is closed.

When the furnace 12 is tilted for teeming as shown in FIG. 2, a column of pollutants, symbolized by the arrows 75, rises from the teaming ladle 42 and from the stream of metal discharging from the spout 40. It can be seen that these pollutants are generally to one side of the furnace 12. During a teeming operation, therefore, the crane 28 is moved to its position wherein the nozzle groups 57 and 58 lie along the opposite sides of the rising column of pollutants 75 and along the margins of the inlet 53. During the teeming operation, therefore, the damper 55 of inlet 53 is open and the damper of inlet 52 is closed. As a result, the air streams from the nozzle assemblies 57 and 58 are directed downwardly from the opposite sides of the rising column of pollutants and inwardly toward the inlet 53.

While only a single embodiment of the invention is illustrated and described, it is not intended to be limited thereby but only by the scope of the appended claims.

I claim:

1. A system for collecting pollutants from an electric arc furnace, said furnace having a removable cover and a teeming spout whereby metallic material may be charged into said furnace and molten products may be discharged into a container disposed adjacent one side of the furnace, an overhead crane movable above the furnace and from side to side for positioning a container of metal above the furnace, pollution collection means disposed above and to one side of said furnace, and including an inlet opening oriented generally toward said furnace, said crane being movable bidirectionally relative to said inlet opening, nozzle means mounted on said crane, said nozzle means being operative for blowing an air stream toward said collection means, said crane being operable to position said nozzle means on the side of said furnace opposite said inlet opening and in alignment with the furnace when the furnace cover is in an open position and metal is being charged into said furnace, said crane being operable to move said nozzle means in a direction parallel to said inlet opening and to a second position whereby the pollutants rising from said container during a teeming operation moves in a path between said nozzle means and said collection means.

2. The system set forth in claim 1 wherein said nozzle means comprises a pair of nozzle assemblies disposed in a spaced apart relation on said crane, said nozzle assemblies being spaced apart in a direction parallel to said inlet opening.

3. The system set forth in claim 1 wherein said inlet opening is elongate and disposed adjacent said furnace and extends in a direction parallel to a line extending between said furnace to said container, a first portion of said inlet opening being in alignment with said furnace and a second portion being in alignment with said container.

4. The system set forth in claim 2 and including first means for pivotally adjusting each nozzle assembly about a horizontal axis and second means for pivotally adjusting each nozzle assembly about a vertical axis.

5. The system set forth in claim 4 wherein said inlet opening is elongate and disposed adjacent said furnace and extends in a direction parallel to a line extending between said furnace to said container, a first portion of said inlet opening being in alignment with said furnace and a second portion being in alignment with said container.

6. The systems set forth in claim 5 wherein each nozzle assembly includes a chamber and a flow deflector, said first means mounting said flow deflector for pivotal movement about a horizontal axis for vertically adjusting the discharge angle of air from said chamber, said second means including support means affixed to said chamber and coupling means for connecting said support to the crane and adapted to pivot said nozzle assembly about a vertical axis to permit horizontal redirection of air discharging from said chamber.

7. The system set forth in claim 6 and including damper means disposed in each of the first and second portions of the inlet opening and adapted to be individually moved between opened and closed positions.

* * * * *